US006760935B1

(12) United States Patent
Burton et al.

(10) Patent No.: US 6,760,935 B1
(45) Date of Patent: Jul. 13, 2004

(54) GUSSETED PILLOW WITH PLEATED TOP AND BOTTOM SECTIONS

(75) Inventors: Robert D. Burton, Shoreline, WA (US); Ralph W. Saterlee, Seattle, WA (US); Shelley A. DiGirolamo, Bellevue, WA (US)

(73) Assignee: Pacific Coast Feather Co., Seattle, WA (US)

( * ) Notice: Subject to any disclaimer, the term of this patent is extended or adjusted under 35 U.S.C. 154(b) by 0 days.

(21) Appl. No.: 10/402,605

(22) Filed: Mar. 28, 2003

(51) Int. Cl.[7] ..... A47G 9/10
(52) U.S. Cl. ..... 5/645; 5/636
(58) Field of Search ..... 5/636–645, 490, 5/491

(56) References Cited

U.S. PATENT DOCUMENTS 2,805,428 A * 9/1957 Buchman ..... 5/645
3,175,230 A * 3/1965 Herdal ..... 5/491
3,443,267 A * 5/1969 Meyers ..... 5/645
4,513,462 A * 4/1985 Thomas ..... 5/645

* cited by examiner

*Primary Examiner*—Michael Trettel
(74) *Attorney, Agent, or Firm*—Jensen & Puntigam, P.S.

(57) ABSTRACT

The gusseted pillow includes a top fabric section, a bottom fabric section and an intermediate gusset portion, wherein the peripheries of the top and bottom fabric sections are each longer than a total length of the gusset portion. The peripheral edges of the top and bottom fabric sections are attached, respectively, to the opposing edges of the gusset portion, with pleats at the corners of the pillow. The pillow is filled to produce a high loft (puffy) appearance, with the portion of the pillow on opposing sides of the gusset portion being elevated from the gusset portion.

8 Claims, 3 Drawing Sheets

GUSSETED PILLOW WITH PLEATED TOP AND BOTTOM SECTIONS

TECHNICAL FIELD

This invention relates generally to pillow construction, and more specifically concerns a gusseted pillow being a particular top and bottom section arrangement and an intermediate gusset portion.

BACKGROUND OF THE INVENTION

Gusseted pillows are in general well known, as shown for instance in U.S. Pat. No. 5,729,851 to Hollander and U.S. Pat. No. 3,109,182 to Doak, each of which generally teach a pillow having a narrow gusset between top and bottom sections. However, the total length of the gusset in those patents is approximately the same as the total length of the peripheral edge of the top and bottom sections, so that when the pillow is sewn together and filled, the top and bottom sections of the pillow tend to curve inwardly toward the center of the pillow in defining the upper and lower surfaces of the pillow.

In general, comfort and appearance are both important aspects of a pillow. Conventional gusseted pillows are generally quite ordinary in comfort, depending to some extent on the fill, and also in appearance. The present invention results in a high loft gusseted pillow, which adds to the overall comfort and appearance of otherwise conventional gusseted pillows.

SUMMARY OF THE INVENTION

Accordingly, the present invention is a gusseted pillow with a pleated portion, comprising: a top fabric section; a bottom fabric section; a center gusset portion having a selected length, wherein the top fabric section is attached along its peripheral edge to an upper edge of the gusset portion, and the bottom fabric section is attached along its peripheral edge to an opposing lower edge of the gusset portion, wherein the periphery of at least one of the top and bottom fabric sections is larger from the length of the gusset portion, and wherein said at least one fabric section has a plurality of pleats at spaced intervals around the periphery thereof where it is attached to said gusset portion; and sufficient filling within the pillow that the pillow puffs up from the gusset portion.

BEST MODE FOR CARRYING OUT THE INVENTION

Figure 1:
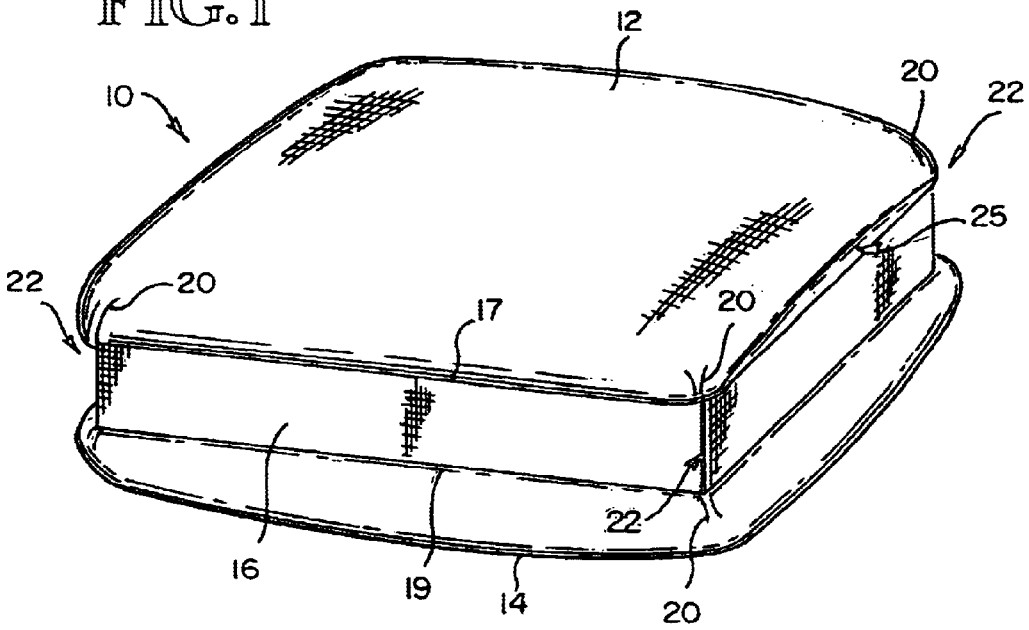
FIG. 1 is a perspective view of one embodiment of the pillow of the present invention.
Figure 2:
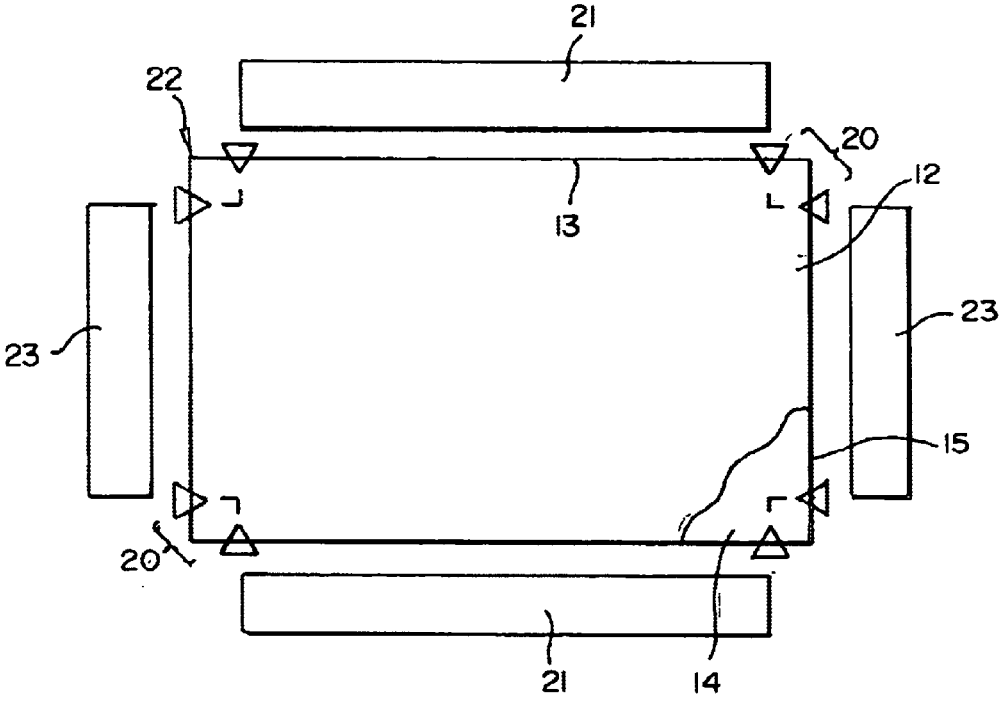
FIG. 2 is a diagram showing the configuration of the top and bottom sections of the pillow of FIG. 1 and the configuration of the gusset portion.

In general, the present invention is a high loft pillow which has a "puffy" appearance, comprising top and bottom fabric sections with a particular configuration and an intermediate gusset portion. Referring to FIGS. 1 and 2, the high loft pillow shown generally at 10 includes identical top and bottom fabric sections 12 and 14 and an intermediate gusset portion 16. The peripheral edges 13, 15 of the top and bottom fabric sections 12, 14 are longer than the corresponding upper (top) and lower (bottom) edges 17, 19 of gusset portion 16. In the embodiment shown, although not necessarily, the top and bottom fabric sections are made of cotton or similar fabric, with a 260 thread count, although this can certainly be varied.

In the embodiment shown, the top and bottom fabric sections are rectangular in configuration, with a length of approximately 23.5 inches (with a 0.5 inch seam allowance) and a width of approximately 16 inches (with a 0.5 inch seam allowance). The gusset portion 16 is also made from cotton or similar material, also with a thread count of 260, although again this can be varied. FIG. 2 also shows the length and width of the gusset portion. Typically, the gusset portion 16 is a continuous strip; it is shown in individual parts in FIG. 2 to match the four sides of the top and bottom sections. In the embodiment shown, the pillow length parts 21 of the gusset are approximately 22 inches (with a 0.5 inch seam allowance) and the pillow width parts 23 of the gusset are 16 inches (with a 0.5 inch seam allowance), for a total gusset length of 76 inches. In the embodiment shown, the width of gusset 16 is approximately two inches.

In FIG. 1, the peripheral edges of the top and bottom fabric sections are sewn, respectively, to the upper (top) and lower (bottom) edges 17 and 19 of gusset portion 16, although one end 25 of the pillow is left open initially to permit filling of the pillow. The top and bottom sections include pleats 20-20 at each corner 22-22 of the top and bottom fabric sections, or at other spaced points along the periphery thereof. Alternatively, a dart could be used or any similar "bunched" arrangement. Hereinafter, the word "pleat" is intended to cover all such arrangements. In the embodiment shown, with the dimensions of the fabric sections and the gusset as set forth above, each pleat is ¾ inches, as shown in FIG. 2. The size of the pleat can vary within the concept of the present invention, depending upon the difference in length between the peripheral edge of the top and bottom fabric sections 12, 14 and the length of gusset portion 16. When the sewn pillow 10 is filled, the top and bottom fabric sections will typically extend upwardly and slightly outwardly from the gusset portion of the pillow, giving a lofted, i.e. puffy, appearance to the pillow, as shown in FIG. 1. The above-described arrangement adds both to the appearance and the comfort of a conventional gusseted pillow.

The sewn pillow can be stuffed in conventional ways, either with feathers or down or a combination thereof or by synthetic products, such as foam or fiber material, either a single block or smaller portions thereof. After filling, the open end 25 of the pillow is sewn shut to complete the construction of the pillow.

As an alternative to the embodiment of FIGS. 1 and 2, one of the top and bottom fabric sections in FIG. 1 could have smaller dimensions than the other, for instance the bottom section could be smaller, resulting in the bottom portion of the pillow being less lofted or puffy. Further, one fabric section could have approximately the same peripheral edge length as the length of the gusset portion, which results in that portion (half) of the pillow having a conventional pillow appearance, while the other half has a high loft or puffy appearance. In such a case, the lower part of the pillow could be filled with foam or fiber material, while the upper portion could be filled with feathers or down.

Figure 3:
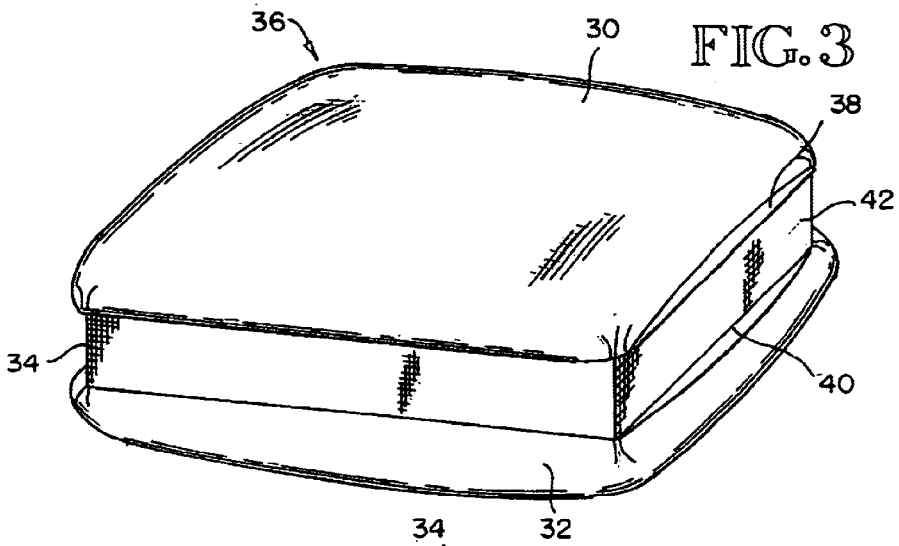
FIGS. 3–5 show a second pillow arrangement using the principles of the present invention.
Figure 4:
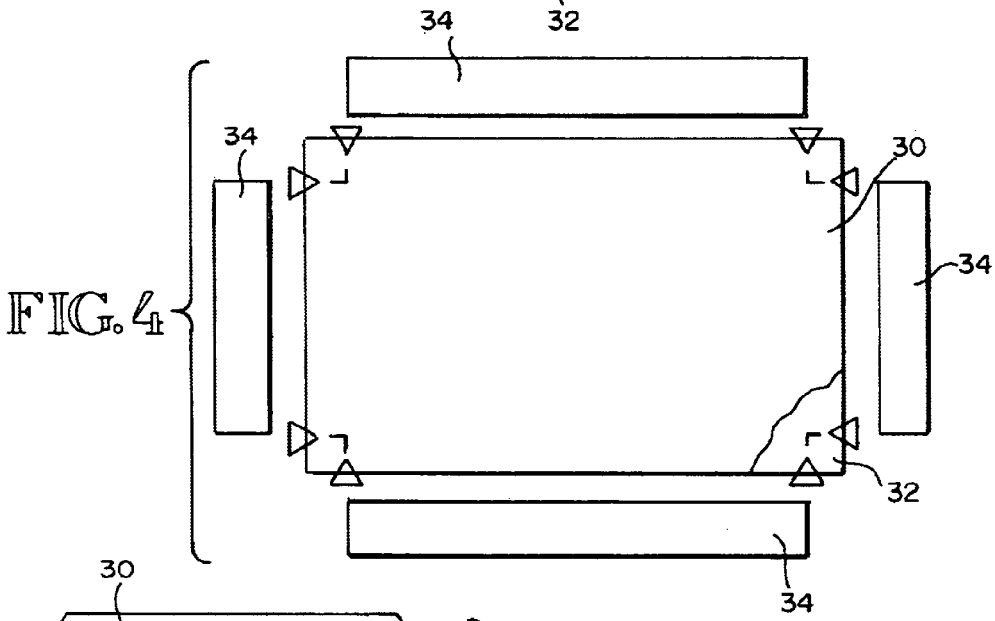
Figure 5:
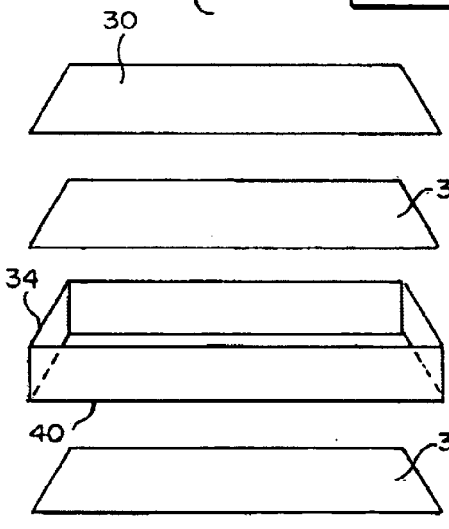

FIGS. 3–5 show a variation of the arrangement of FIGS. 1 and 2. In this arrangement, the top and bottom fabric sections 30 and 32 and the gusset portion 34 of pillow 36 are basically the same as in the first embodiment shown in FIGS. 1 and 2, and are secured to each other in the same way, providing the same desired high loft, puffy appearance. This embodiment, however, includes upper and lower intermediate fabric sections 38, 40, which are secured internally of the pillow 36 to the upper and lower edges of gusset portion 34. The edge dimensions (length) of the intermediate fabric sections 38, 40 are substantially identical to the edge dimensions (total length) of gusset portion 34.

The intermediate fabric sections 38 and 40 form a middle chamber 42, which is typically filled with feathers, while the portions of the pillow between the upper intermediate and top fabric sections and the lower intermediate and bottom fabric sections are filled with down. The middle chamber 42 could also be filled with down. The top and bottom fabric sections include pleats 40-40 (or darts or similar arrangements) at their respective corners, or alternatively at selected spaced points along the periphery thereof. The size of the pleats, as with the embodiment of FIGS. 1 and 3, can vary, depending upon the relative dimensions of the top and bottom fabric sections and the overall length of gusset portion 34.

Figure 6:
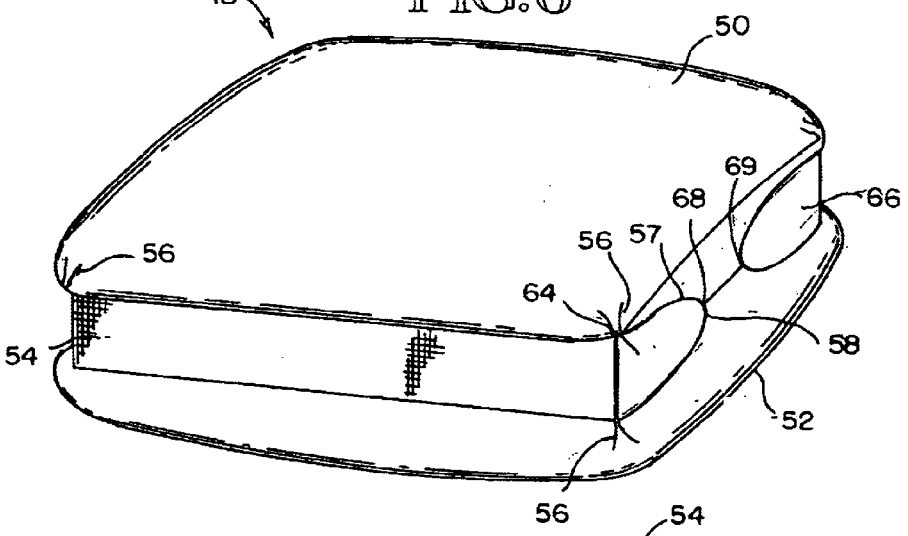
FIGS. 6–8 show another pillow arrangement using the principles of the present invention.
Figure 7:
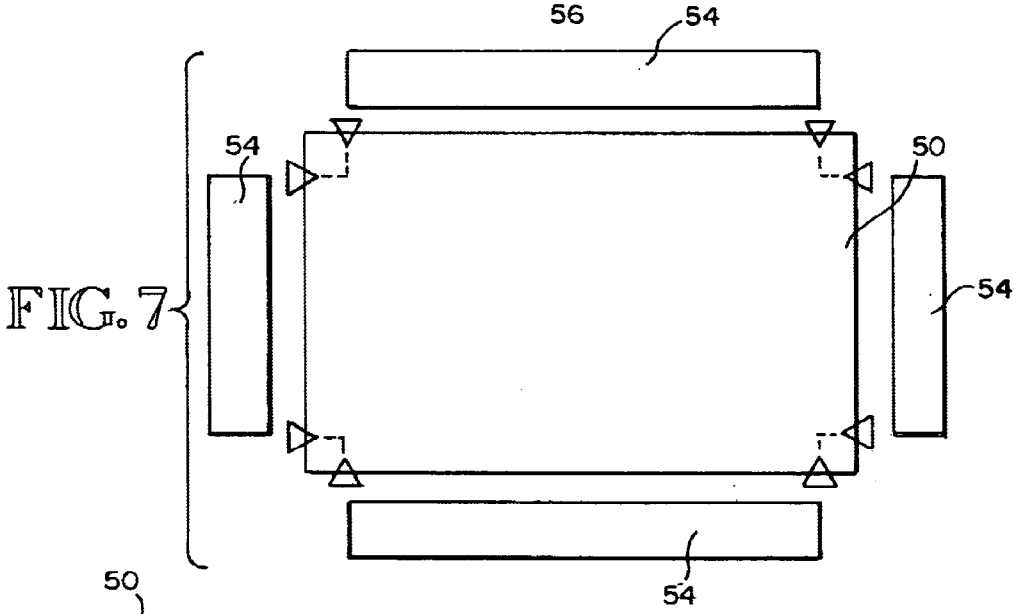
Figure 8:
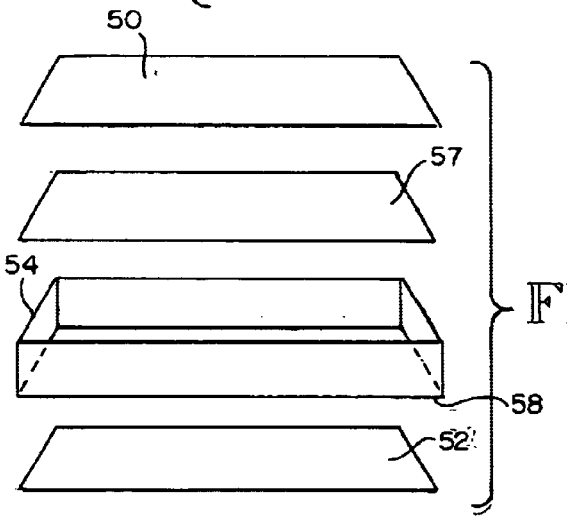

FIGS. 6–8 show another internal construction for a pillow 48 using the structure of the present invention. Pillow 48 includes top and bottom fabric sections 50 and 52 and an intermediate gusset portion 54, similar to that of the other embodiments. FIG. 7 shows gusset portion 54 in four sections, although it is actually a single length of fabric. Again, as in the other embodiments, the peripheral edges of the top and bottom fabric sections 50 and 52 are longer than the total length of gusset portion 54. Further, pleats 56-56 are provided at the corners of the top and bottom sections where they meet gusset 54, or at other spaced points along the periphery, such that the pillow of FIGS. 5–8 has the same high loft or "puffy" appearance as the other two embodiments.

The internal construction of pillow 48 is a variation of that of FIGS. 3–5. Pillow 48 includes upper intermediate and lower intermediate fabric sections 57 and 58 within the pillow. However, instead of the upper and lower intermediate fabric sections extending separately from each other across the entire width of the pillow, at least one line of stitching extends longitudinally of the pillow, connecting the upper and lower intermediate sections, thereby defining two internal chambers 64 and 66 within the pillow. More specifically, as shown in FIG. 6, two parallel lines of stitching 68, 69 connect the upper and lower intermediate fabric sections longitudinally of the pillow, with a width of approximately one inch between them. The internal chambers 64 and 66 extend from the lines of stitching 68, 69 outwardly to the longitudinal edges of the pillow, specifically the upper and lower edges of the longitudinal portions of the gusset portion.

Typically, chambers 64, 66 will be filled with feathers, while the remaining portions of the pillow between the upper and lower intermediate sheets 57 and 58 and the top and bottom fabric sections 50 and 52 will be down. However, this can be varied; for instance, the entire pillow can be filled with down, or in some cases, the entire pillow can be filled with feathers, although typically this is less desirable. Also, the filling could be synthetic material, such as fiber.

It should be understood that other internal structures for the basic pillow of the present invention are possible. The pillow of the present invention comprises top and bottom fabric sections and an intermediate gusset portion, with the three sections having a configuration and arrangement such that the pillow has a high loft or puffy appearance when filled.

Although a preferred embodiment of the invention has been described for purposes of illustration, it should be understood that various changes, modification and substitutions may be incorporated in the embodiment without departing from the spirit of the invention which is defined in the claims which follow.

What is claimed:

1. A gusseted pillow with pleated portion, comprising:

a top fabric section;

a bottom fabric section;

a center gusset portion having a selected length, wherein the top fabric section is attached along its peripheral edge to an upper edge of the gusset portion and the bottom fabric section is attached along its peripheral edge to an opposing lower edge of the gusset portion, wherein the periphery of at least one of the top and bottom fabric sections is longer than the length of the gusset portion, and wherein said at least one fabric section has a plurality of pleats at spaced intervals around the periphery thereof where it is attached to said gusset portion; and sufficient filling within the pillow that the pillow puffs up from the gusset portion.

2. The pillow of claim 1, wherein the top and bottom fabric sections are substantially identical, and both include pleats at a plurality of spaced intervals around the peripheries thereof where they are attached to the gusset portion.

3. The pillow of claim 2, wherein the peripheral edge of the top and bottom fabric sections is at least two inches longer than the length of the gusset portion.

4. The pillow of claim 1, wherein the pleats are located approximately at the corners of the pillow.

5. The pillow of claim 4, wherein the pleats are approximately ¾ inch.

6. The pillow of claim 2, including upper and lower intermediate sheet sections located internally of the pillow and attached along their peripheral edges to the gusset portion, wherein the upper and lower intermediate sheets have a peripheral edge length substantially identical to the length of the gusset portion.

7. The pillow of claim 6, wherein the filling includes feathers between the upper and lower intermediate sheets, and down between the top fabric section and the upper intermediate sheet and between the bottom fabric section and the lower intermediate sheet.

8. The pillow of claim 6, including at least one line of stitching longitudinally of the pillow connecting the upper and lower intermediate sheets, thereby defining first and second internal chambers for the pillow between the upper and lower intermediate sheets and third and fourth internal chambers between the upper and lower intermediate sheets, respectively, and the top and bottom fabric sections.

* * * * *